US008844184B2

(12) United States Patent
Tusting

(10) Patent No.: US 8,844,184 B2
(45) Date of Patent: Sep. 30, 2014

(54) CONCEALABLE REVOLVER

(71) Applicant: Paul A. Tusting, Salt Lake City, UT (US)

(72) Inventor: Paul A. Tusting, Salt Lake City, UT (US)

(73) Assignee: Ironmonger Arms LLC, Salt Lake City, UT (US)

( * ) Notice: Subject to any disclaimer, the term of this patent is extended or adjusted under 35 U.S.C. 154(b) by 0 days.

(21) Appl. No.: 13/968,179

(22) Filed: Aug. 15, 2013

(65) Prior Publication Data

US 2014/0047752 A1 Feb. 20, 2014

Related U.S. Application Data

(60) Provisional application No. 61/691,229, filed on Aug. 20, 2012.

(51) Int. Cl.

| | |
|---|---|
| ***F41A 17/00*** | (2006.01) |
| ***F41A 3/14*** | (2006.01) |
| ***F41C 3/14*** | (2006.01) |
| *F41C 33/04* | (2006.01) |

(52) U.S. Cl.

CPC ..... *F41A 17/00* (2013.01); *F41C 33/048* (2013.01); *F41C 3/14* (2013.01)

USPC ..... 42/66; 42/59

(58) Field of Classification Search

CPC ..... F41C 3/14

USPC ..... 42/66, 59, 62, 65, 39.5, 67, 1.09; 89/155

See application file for complete search history.

(56) References Cited

U.S. PATENT DOCUMENTS

| | | | | |
|---|---|---|---|---|
| 119,048 | A * | 9/1871 | Richards | 42/59 |
| 627,966 | A | 7/1899 | Behr | |
| 630,478 | A | 8/1899 | Behr | |
| 4,694,602 | A * | 9/1987 | Pust | 42/59 |
| 5,974,941 | A * | 11/1999 | Kushnir et al. | 89/155 |
| 7,523,578 | B2 * | 4/2009 | Ghisoni | 42/59 |

FOREIGN PATENT DOCUMENTS

| | | |
|---|---|---|
| GB | 11998 | 0/1898 |

OTHER PUBLICATIONS

'58 Remington Conversion Cylinders for Pietta or Uberti made Revolvers, KIRST Konverter LLC, www.kirstkonverter.com/1858-remington.html.

1858 New Army .45 Uberti, Howell Old West Conversions LLC, http://www.howelloldwestconversions.com/shop/productinfo.cfm?catID=261&productid=818&cfid=2724164&cftoken=7151c0a5825a265c-9BBF6F26-EF93-94D4-001CF7C0BE8861DA.

1860 .45 Colt/Schofield, Howell Old West Conversions LLC, http://www.howelloldwestconversions.com/shop/productinfo.cfm?catID=261&productid=806&cfid=2724164&cftoken=7151c0a5825a265c-9BBF6F26- EF93-94D4-001CF7C0BE8861DA.

* cited by examiner

*Primary Examiner* — Reginald Tillman, Jr.

(74) *Attorney, Agent, or Firm* — Dobbin IP Law P.C.; Geoffrey E. Dobbin

(57) ABSTRACT

The present invention is a spring-actuated, concealable revolver utilizing a flattened cylinder shape and a unique off-chamber placement of the cylinder when in a stowed safe mode. An extendable grip tag may also be employed to provide a further reduced profile. Various grip styles, unloading mechanisms and advancing actions may be employed with the revolver. Single and double action embodiments are disclosed.

19 Claims, 19 Drawing Sheets

CONCEALABLE REVOLVER

CROSS-REFERENCES TO RELATED APPLICATIONS

This Application claims priority as a non-provisional perfection of prior filed U.S. Provisional Application No. 61/691,229, filed Aug. 20, 2012 and incorporates the same herein by reference in its entirety.

FIELD OF THE INVENTION

The present invention relates to the field of firearms and more particularly relates to a concealable spring-actuated revolver.

BACKGROUND OF THE INVENTION

Personal defense is a matter of choice for individuals. Some choose to not have any, others prefer training in martial arts, some choose a weapon. Often times, that weapon is a small handgun, so the use of a small handgun for personal defense is well known. Private citizens conceal them in their clothing or other objects. Law enforcement and military personnel conceal them on their persons as a "back-up" weapon, in case their primary weapon fails or situations become dire. The ideal back-up weapon is ideally small and easily concealable. Their positioning is not to hinder the movement of the carrier. They tend to carry a few rounds of ammunition and maybe have some container or magazine to carry spare rounds. They tend not to be very accurate at a distance.

The present invention is a revolver suitable for a back-up weapon. It is a spring-actuated revolver with a small stowage profile suitable for concealment. Its structure provides a smaller profile than prior art revolvers while also providing a unique safety feature to prevent accidental discharge.

SUMMARY OF THE INVENTION

In view of the foregoing disadvantages inherent in the known types of revolvers, this invention provides a concealable spring-loaded revolver. As such, the present invention's general purpose is to provide a new and improved revolver that is compact, concealable, easily constructed, and safe when in a concealable configuration.

To accomplish these objectives, the revolver comprises a unique four-chambered cylinder. The cylinder, rather than being totally round, features two opposite flat sides. Ideally, the cylinder is spring actuated, though other means of rotating the cylinder, such as a ratchet mechanism, are possible. When not in use, the hammer resides over a solid space of the cylinder rather than over a chamber, providing a built-in safety system. An extendable grip is also provided, further reducing the weapon profile when not in use.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

Figure 1:
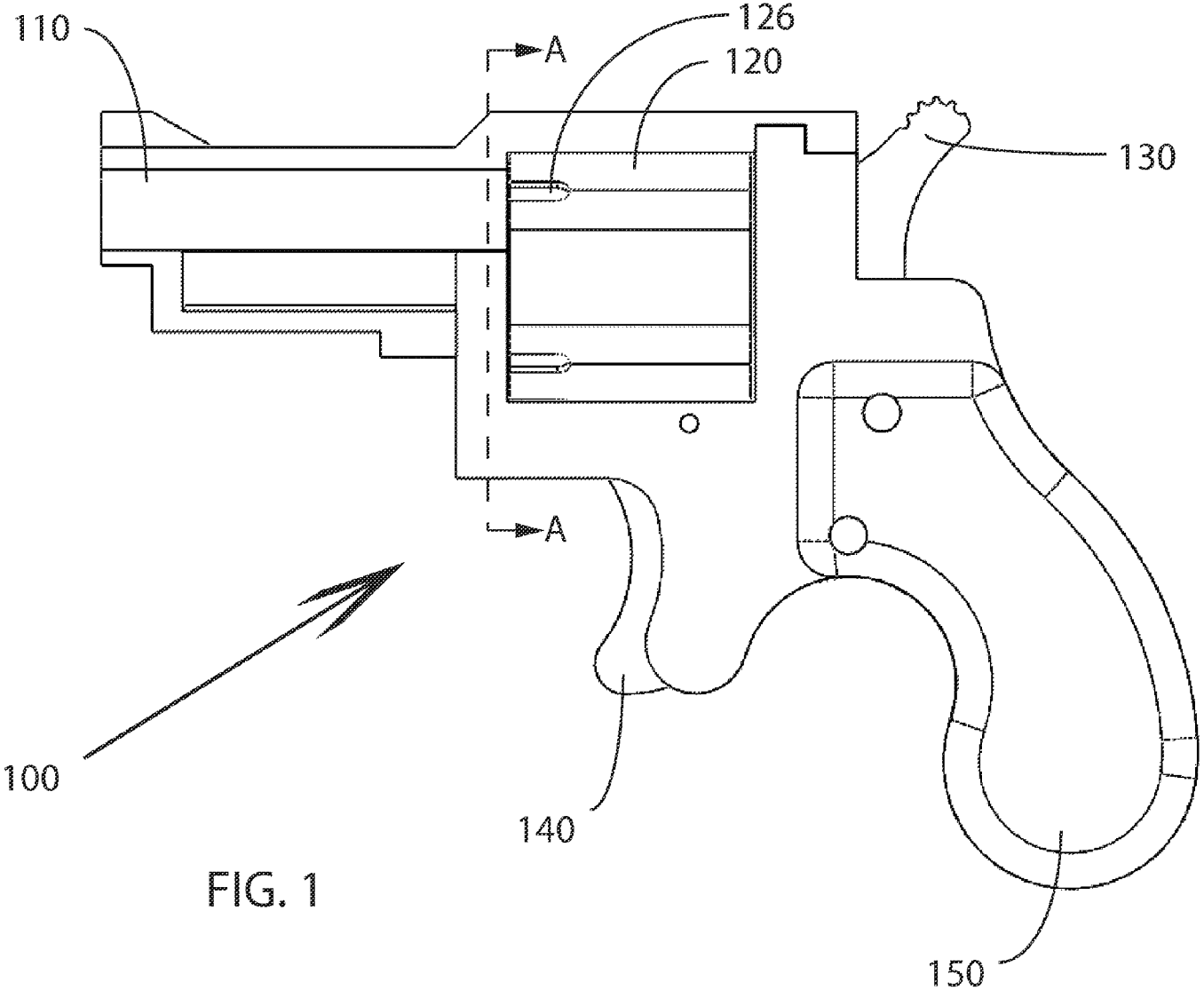
FIG. 1 is a side elevation of one embodiment of a revolver according to the present invention.

With reference now to the drawings, the preferred embodiment and alternate embodiments of the revolver are herein described. It should be noted that the articles "a", "an", and "the", as used in this specification, include plural referents unless the content clearly dictates otherwise. Reference numerals indicated in the specification are consistent through all drawing sheets and indicate the following items:

100—a single action revolver embodying the primary aspects of the present invention;

110—barrel
112—cylinder spring
114—cylinder locking bar
116—locking bar key
118—locking bar pivot
120—revolver cylinder
122—cylinder chambers
124—cylinder stop
126—cylinder position lock grooves
128—cylinder safety lock groove
130—hammer
132—hammer pawl
134—locking bar plate
136—hammer detent groove
138—sear-spur
140—trigger
142—locking bar chamfer
144—base pin
146—rifling grooves
148—rifled cylinder
150—handgrip
200—an alternate revolver embodiment
210—alternate barrel
220—alternate cylinder
222—alternate chamber
224—alternate cylinder stop
226—alternate position lock groove
230—alternate hammer
240—alternate grip
242—extension tang
244—cartridge storage

300—a double action revolver embodying the primary aspects of the present invention

310—barrel
312—cylinder spring
314—cylinder locking bar
316—locking bar key
320—revolver cylinder
326—cylinder position lock grooves
328—cylinder safety lock groove
330—hammer
332—hammer pawl
334—locking bar plate
336—hammer detent groove
338—sear-spur
340—trigger
344—drawbar end ramp
346—drawbar
348—guide pin
350—handgrip With reference to FIG. 1, a revolver 100 has the main components expected of a revolver, that is to say it has a barrel 110, cylinder 120, hammer 130, trigger 140 and grip 150 all mounted upon a frame or receiver. Its internal workings, however, shown in FIGS. 2-5, however, reveal a different sort of weapon. First, the cylinder 120 is powered by a torsion-type cylinder spring 112 mounted beneath the barrel 110. A pivoting locking bar 114 maintains the cylinder 120 against the spring pressure. The forward end of the locking bar 114 is a locking bar key 116 designed to interface with specifically positioned lock grooves 126,128 on a forward end of the cylinder 120. The end of the locking bar opposite the key features a locking bar plate 134 which interfaces with a hammer pawl 132 pivotably mounted upon the hammer 130.

Figure 2:
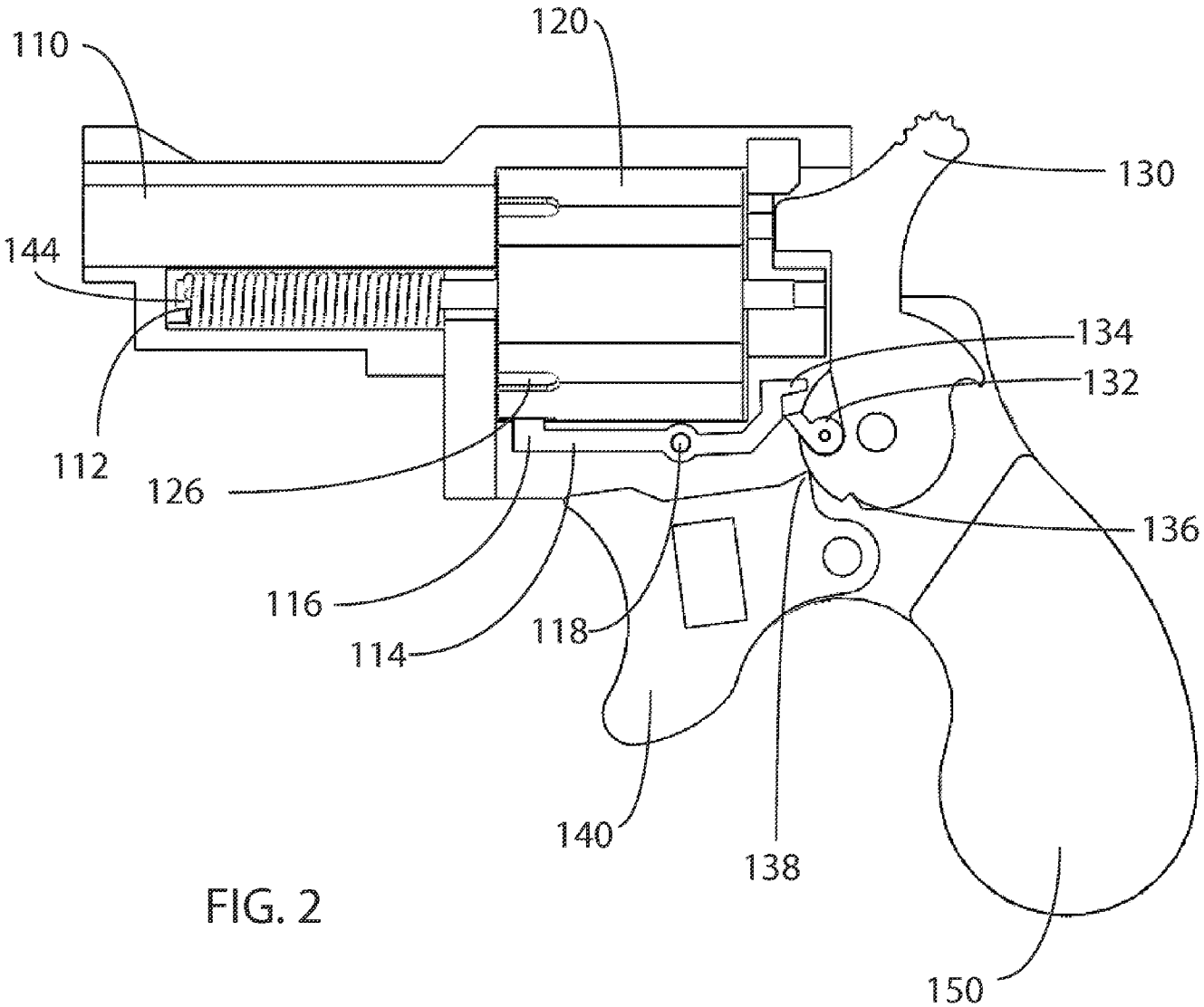
FIG. 2 is a sectional view of the revolver of FIG. 1 in a stowed orientation.
Figure 3:
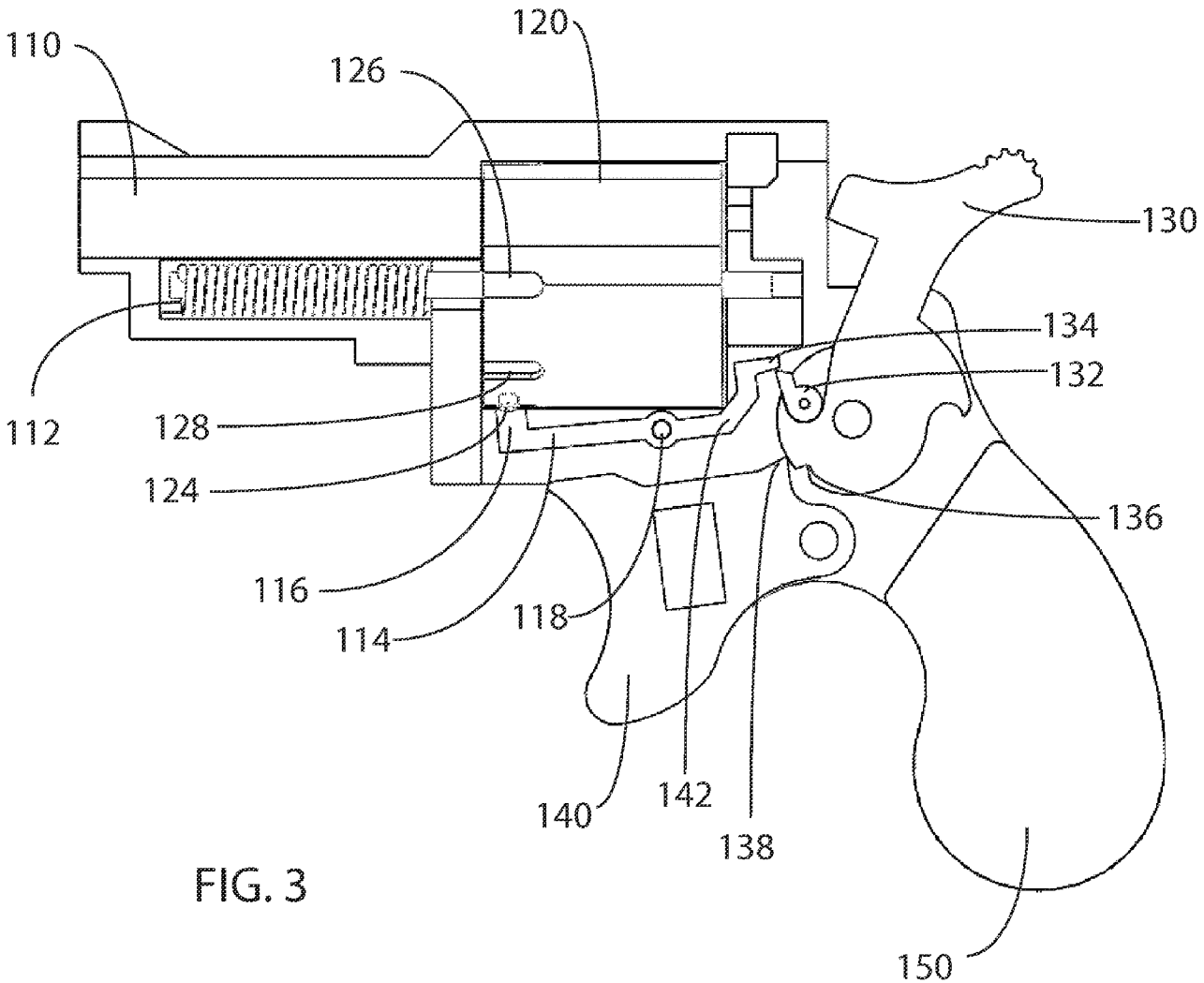
FIG. 3 is a sectional view of the revolver of FIG. 1, in the process of cocking.
Figure 4:
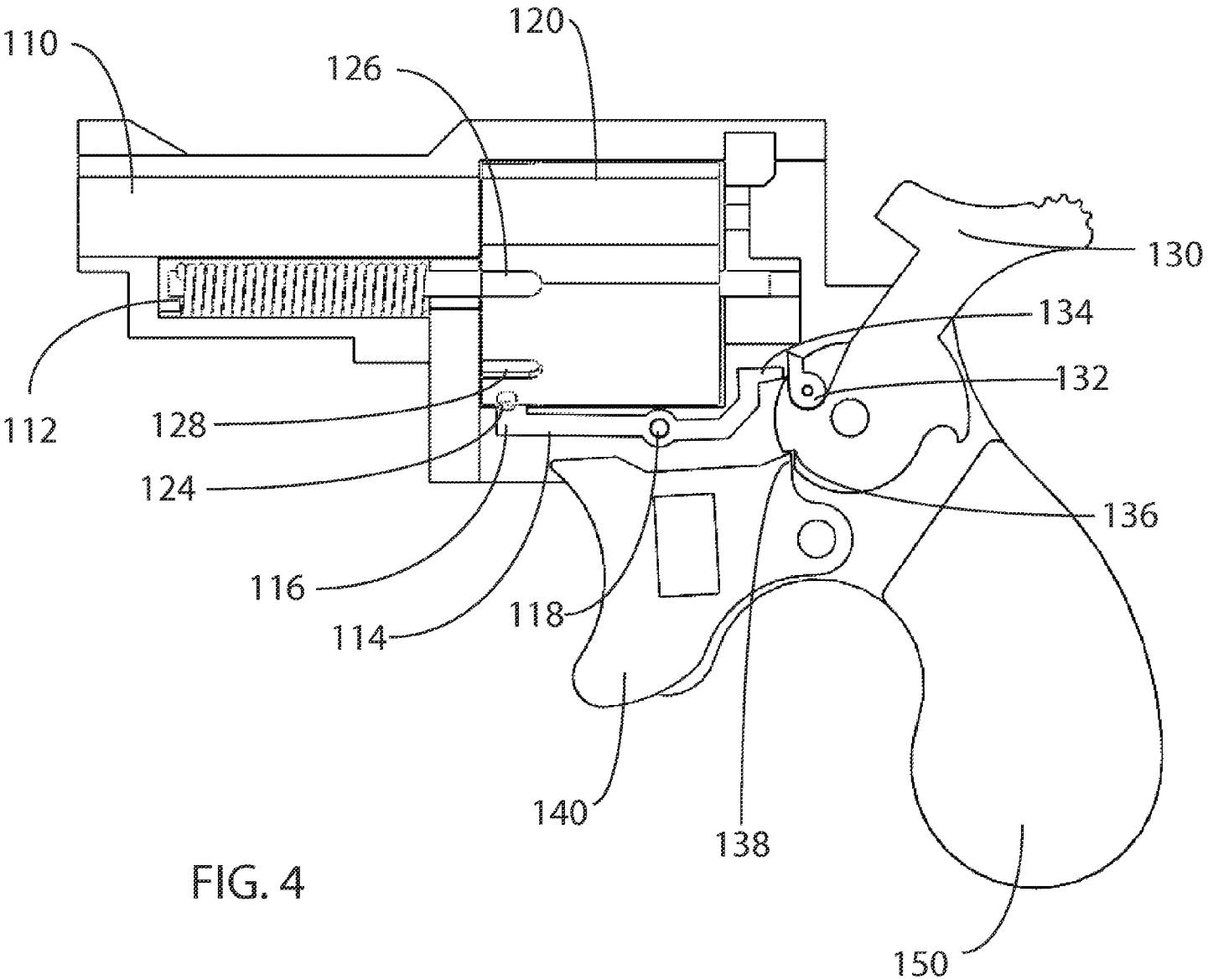
FIG. 4 is a sectional view of the revolver of FIG. 1, fully cocked.
Figure 5:
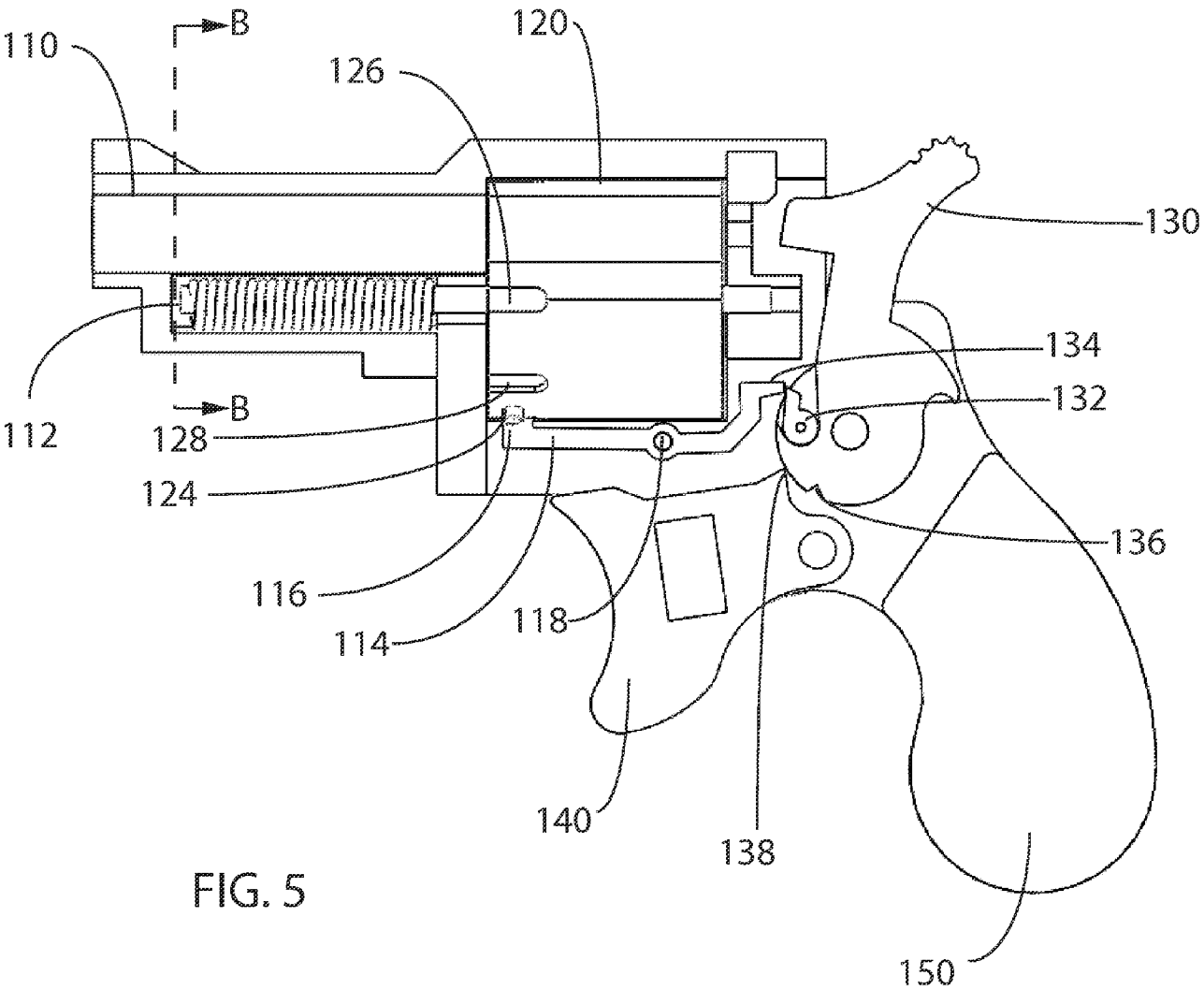
FIG. 5 is a sectional view of the revolver of FIG. 1, firing.
Figure 7:
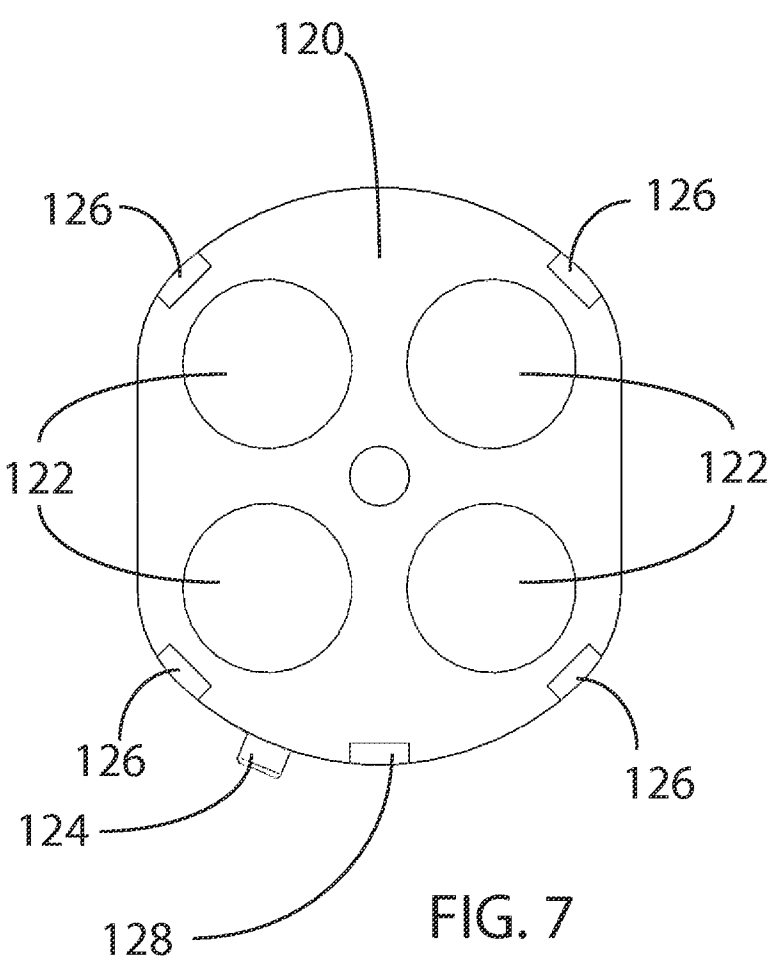
FIG. 7 is a front elevation of the cylinder of the revolver of FIG. 1.
Figure 9:
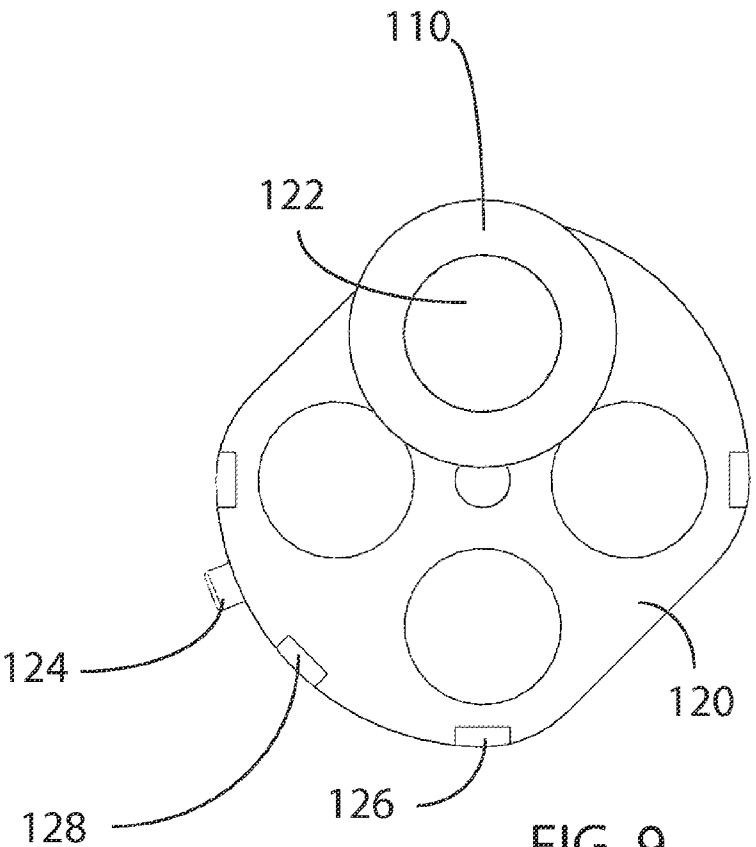
FIG. 9 is a front sectional view of the cylinder and barrel FIG. 8, with the first cylinder ready to fire.
Figure 8:
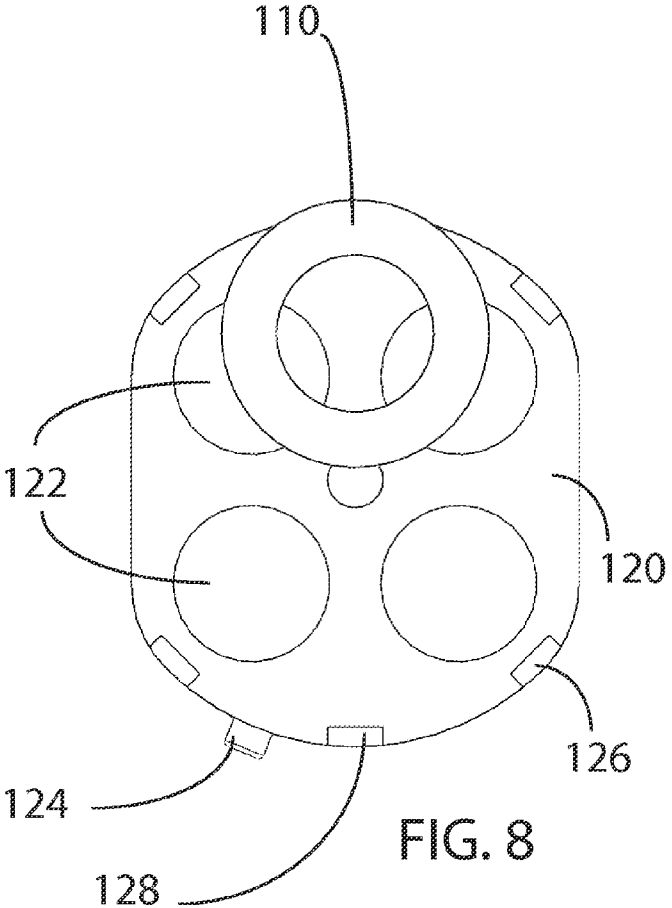
FIG. 8 is a front sectional view of the cylinder and barrel of the revolver of FIG. 1, taken along line A-A, in a stowed orientation, with the frame and base pin removed for clarity.
Figure 11:
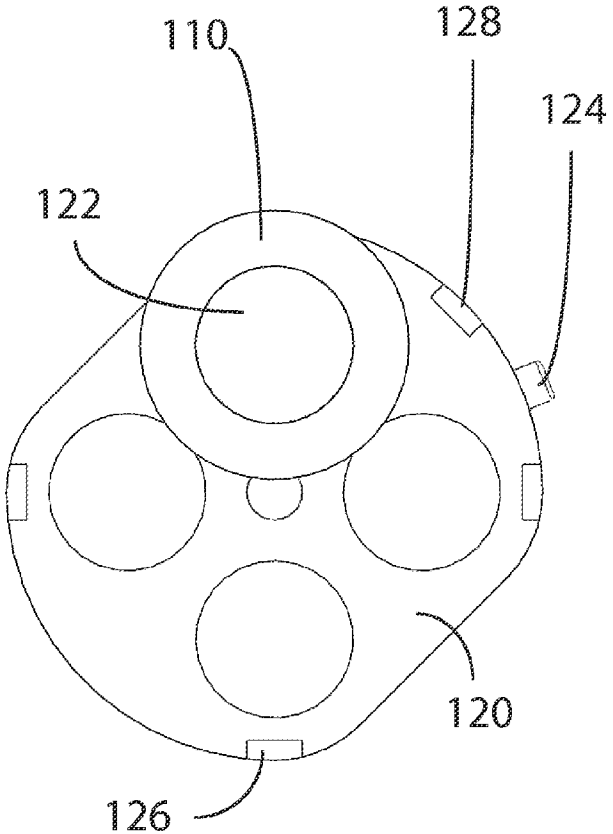
FIG. 11 is a front sectional view of the cylinder and barrel FIG. 8, with the third cylinder ready to fire.
Figure 10:
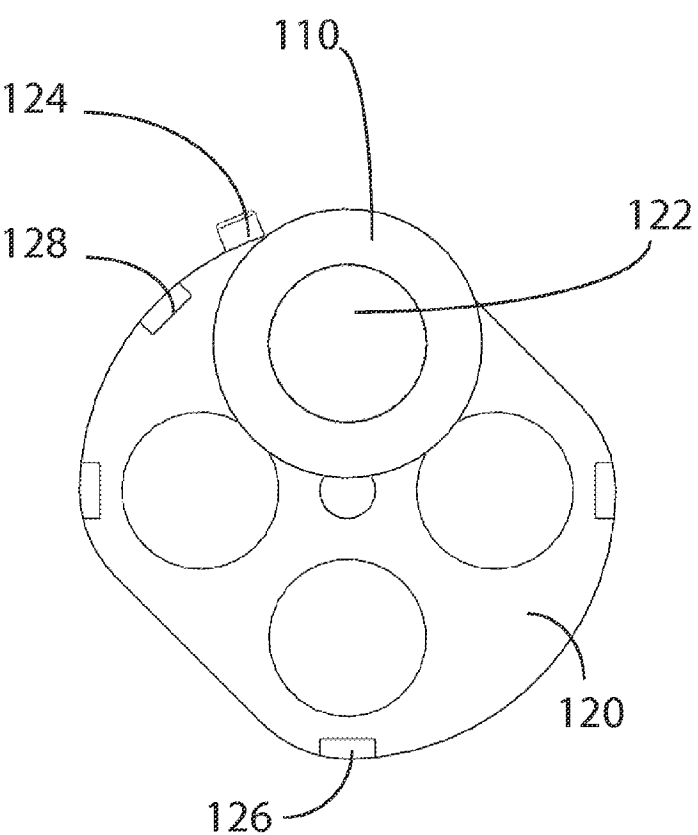
FIG. 10 is a front sectional view of the cylinder and barrel FIG. 8, with the second cylinder ready to fire.

When stowed, FIGS. 2 and 8, the cylinder rests in a unique position off-chamber from the bore of the barrel 110 (and consequently the hammer 130). It is held in this position by the locking bar key 116 residing in a specially positioned safety lock groove 128 (shown in FIGS. 3 and 7). In subsequent use, the action of cocking the hammer 130 (FIG. 3) drives the hammer pawl 132 against the locking bar plate 134, pushing it upwards. The locking bar 114 pivots about its pivot point 118 and forces the locking bar key 116 downward, releasing the cylinder 120. Immediate over-rotation of the cylinder is prevented (FIG. 3) by a chamfer 142 in the locking bar 114. The chamfer 142 stops rotation of the cylinder 120 by blocking one of its corners. Other structures may of course be utilized, including having other structure on the cylinder interface with the chamfer 142 or other movable blocking structure,; however, this embodiment is preferred. In the fully cocked position (FIG. 4), the hammer pawl 132 has passed beyond the locking bar plate 134, releasing it and thereby forcing the locking bar key 116 to move upwards into the next successive position lock groove 126. In this position, the revolver is ready to fire (FIG. 9) with a chamber 122 in line with the barrel 110 and hammer 130. An interface with the trigger 140 holds the hammer 130 in cocked position. The illustrated mechanism is a simple spur-and-groove lock where a sear-spur 138 on the trigger 140 interfaces with a groove 136 on the hammer 130. Other structures of sears may of course be used. Upon firing (FIG. 5), the sear lock is broken and the hammer 130 begins to return. The pawl 132 rotates against the locking bar plate 134 and into a crevice in the hammer 130 until the pawl 132 is moved away from the locking bar plate 134 and returns to its position underneath the locking bar plate 134.

Figure 6:
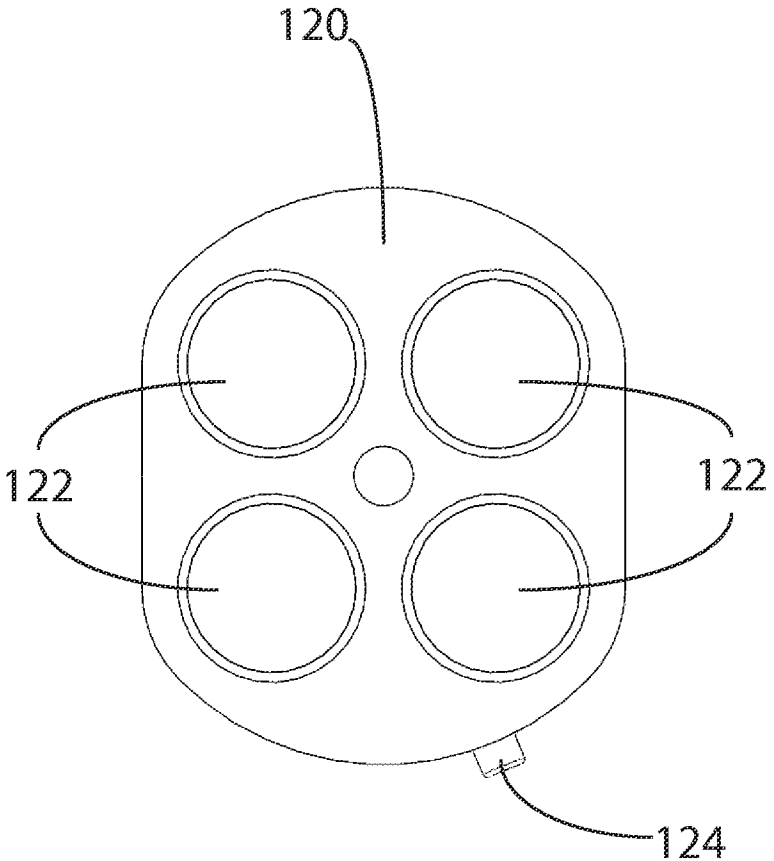
FIG. 6 is a rear elevation of the cylinder of the revolver of FIG. 1.
Figure 13:
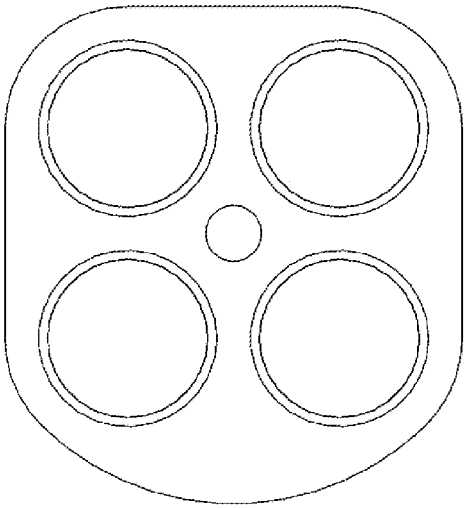
FIG. 13 is a sectional view of an alternate cylinder embodiment.
Figure 12:
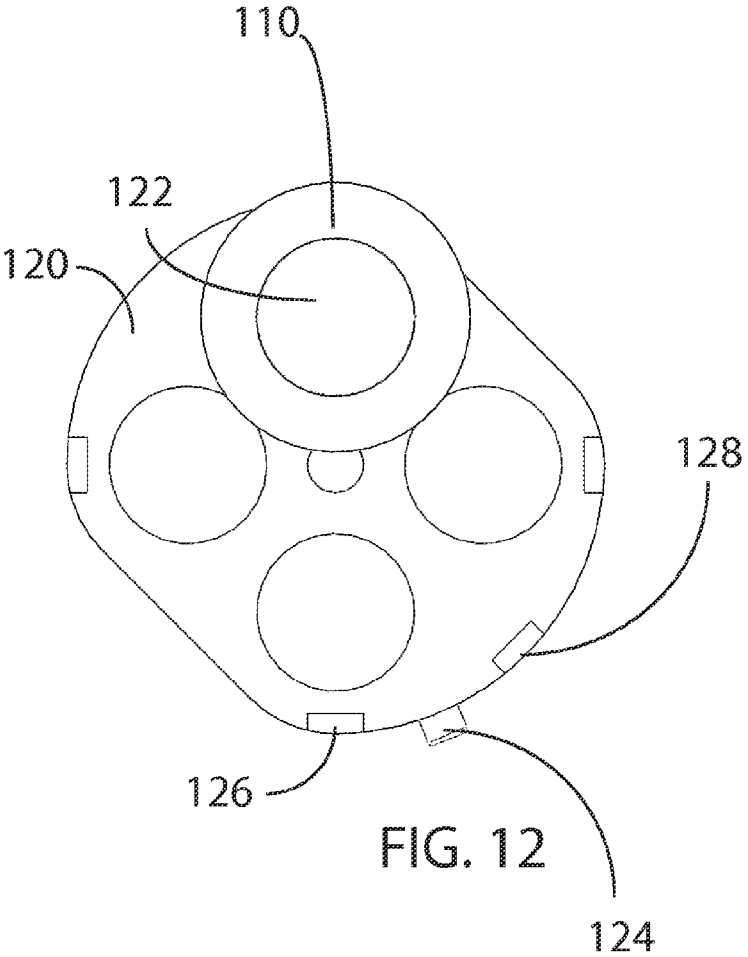
FIG. 12 is a front sectional view of the cylinder and barrel FIG. 8, with the fourth cylinder ready to fire.

The cylinder 120 provides a slim profile to aid in concealment. As can be seen in FIGS. 6 and 7, the cylinder is uniquely shaped. There are limited lines of symmetry with the design of the cylinder and the outside surface of the cylinder proximate each chamber is not consistant relative to the axis of rotation of the cylinder. For purposes of this Application, I term this relation to be "non-radially symmetric," as any symmetry in the cylinder is not necessarily tied to all of the radii of the cylinder (though some lines of symmetry may coincide with certain diameters). This design is intentional and ideally presents two opposing flat sides so that when stowed the flat sides are presented outward. It is, of course, possible for three (FIG. 13) or even four sides to be flattened. The flattened profile crates four corners, in which the four chambers 122 should ideally reside. Accordingly, the cylinder position lock grooves 126 should also ideally be located in each corner. Arrangement of the cylinder, however, is determined by choice of the designer and the chambers 122 and cylinder position lock grooves 126 may be on any location of the cylinder 120. The safety lock groove 128 is then positioned between two of the cylinder position lock grooves 126, proximate a cylinder stop 124. As the cylinder 120 cycles through the chambers 122, the cylinder stop 124 is rotated about the axis of the cylinder until it interfaces with structure that prevents further rotation of the cylinder 120 (FIGS. 8-12). For simplicity, cylinder stop 124 is depicted as a post extending from the perimeter of the cylinder; however, other structures on the frame or cylinder may be utilized. When stowed, the locking bar key 116 resides in safety lock groove 128. This position presents at least two flat sides outward of the revolver frame, reducing the weapon profile.

Figure 14:
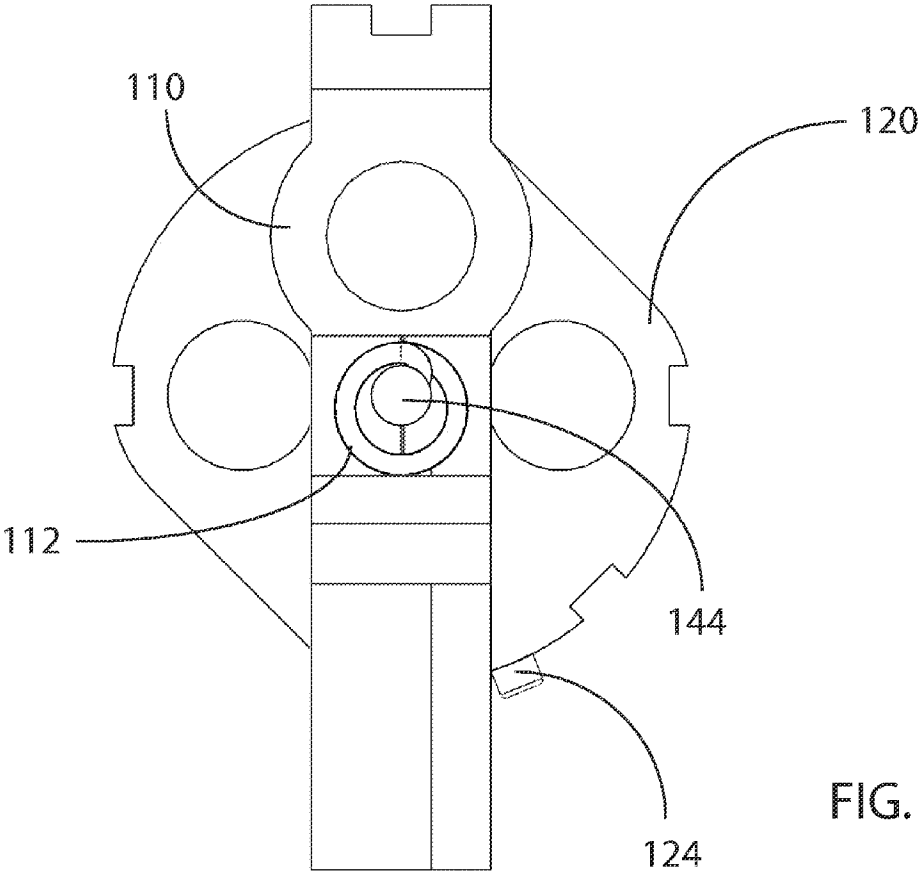
FIG. 14 is a front sectional view, taken in front of the cylinder, taken along line B-B in FIG. 5.
Figure 15:
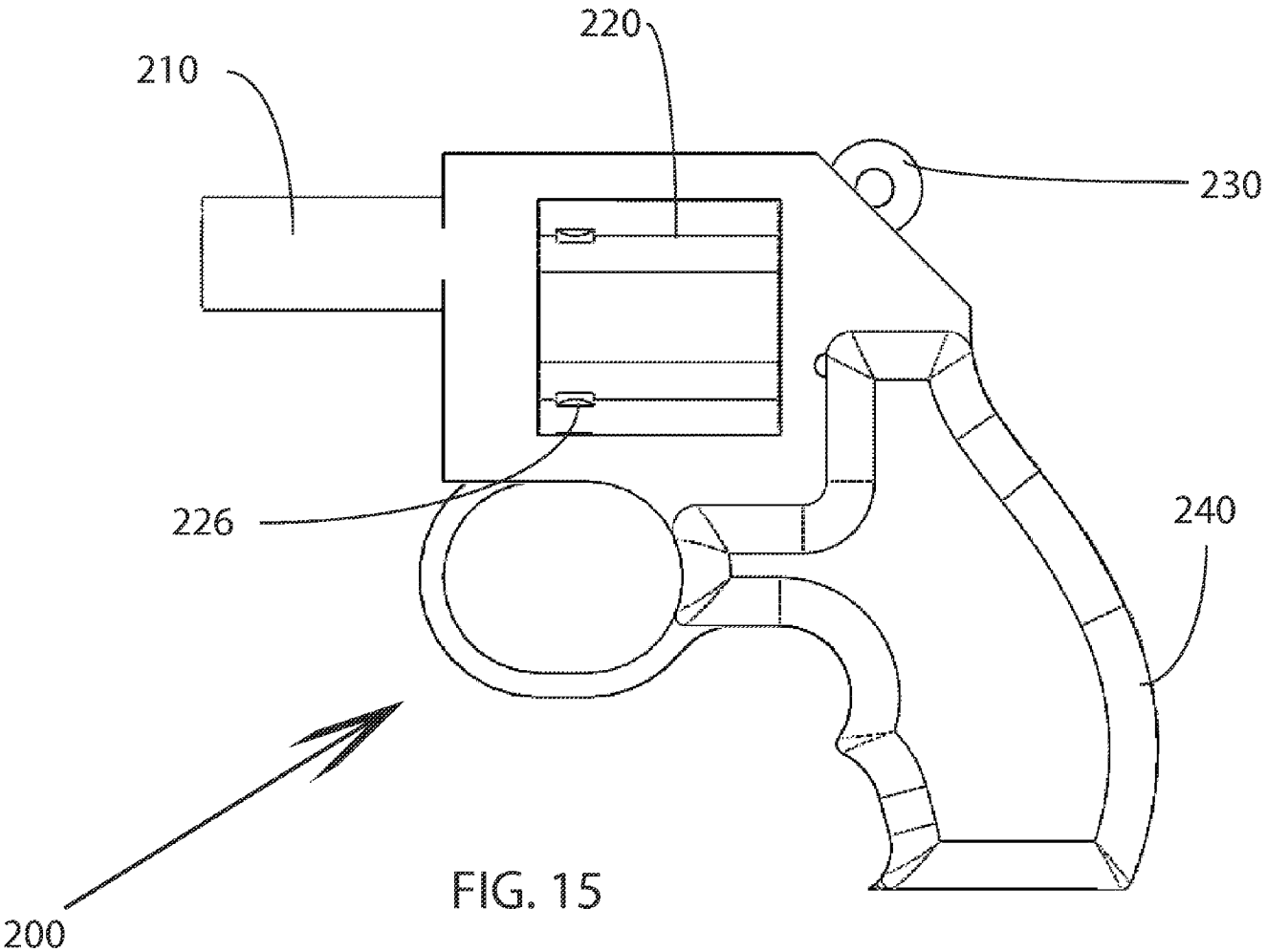
FIG. 15 is a side elevation of a second embodiment of a revolver according to the present invention.
Figure 16:
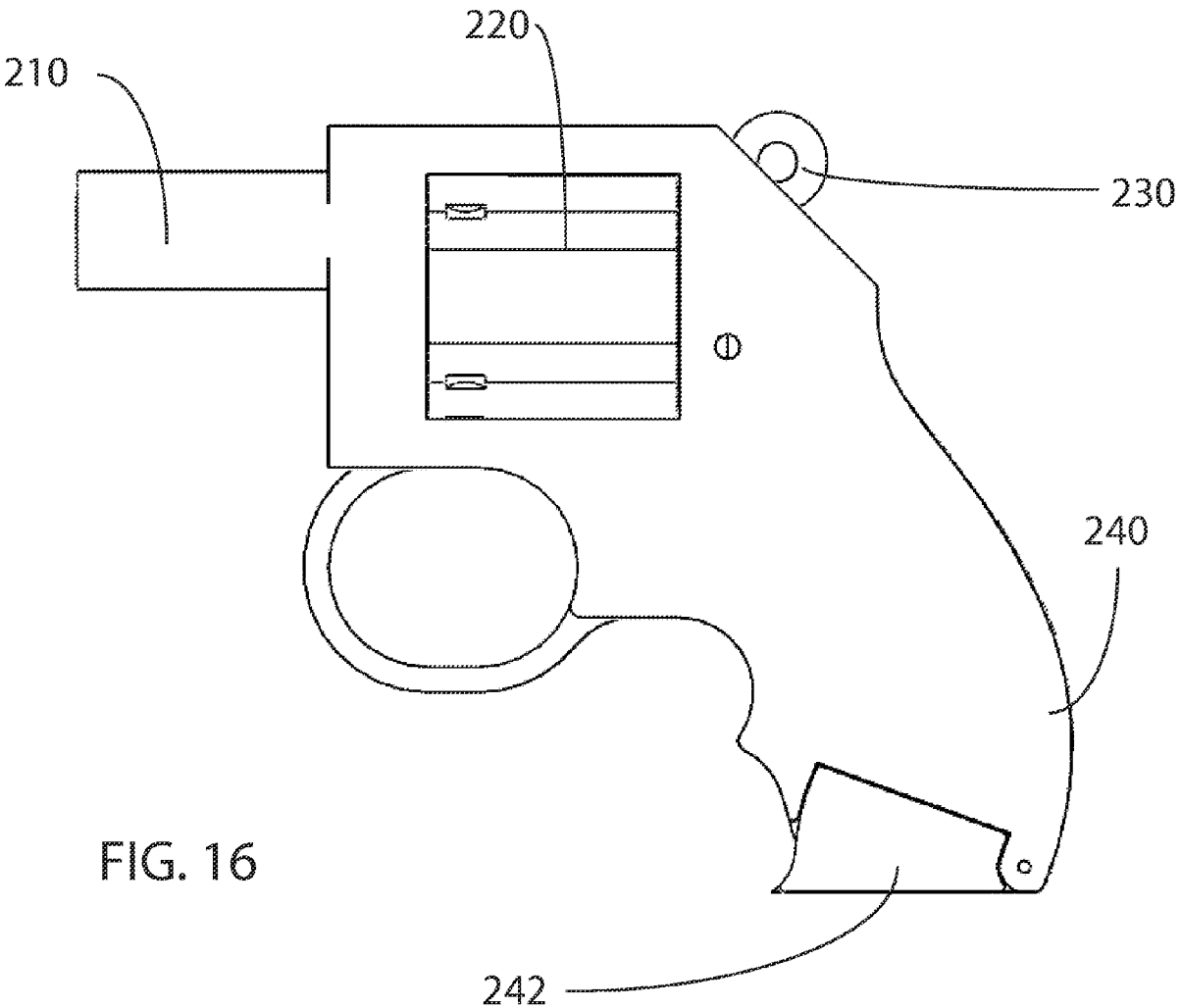
FIG. 16 is a sectional view of the revolver of FIG. 15, with a stowed grip extension tang.

Further enhancing the slim profile of the weapon is the placement of the cylinder spring 112. The cylinder spring 112 is located outside the cylinder 120, ideally below the barrel 110 of the weapon. The cylinder spring is may or may not be mounted in a non-concentric relation with the cylinder axle/base pin 144 (which is axially related to the cylinder), as shown in FIG. 14. A non-concentric relation allows for a stronger spring to be used to power the rotation of the cylinder.

Figure 17:
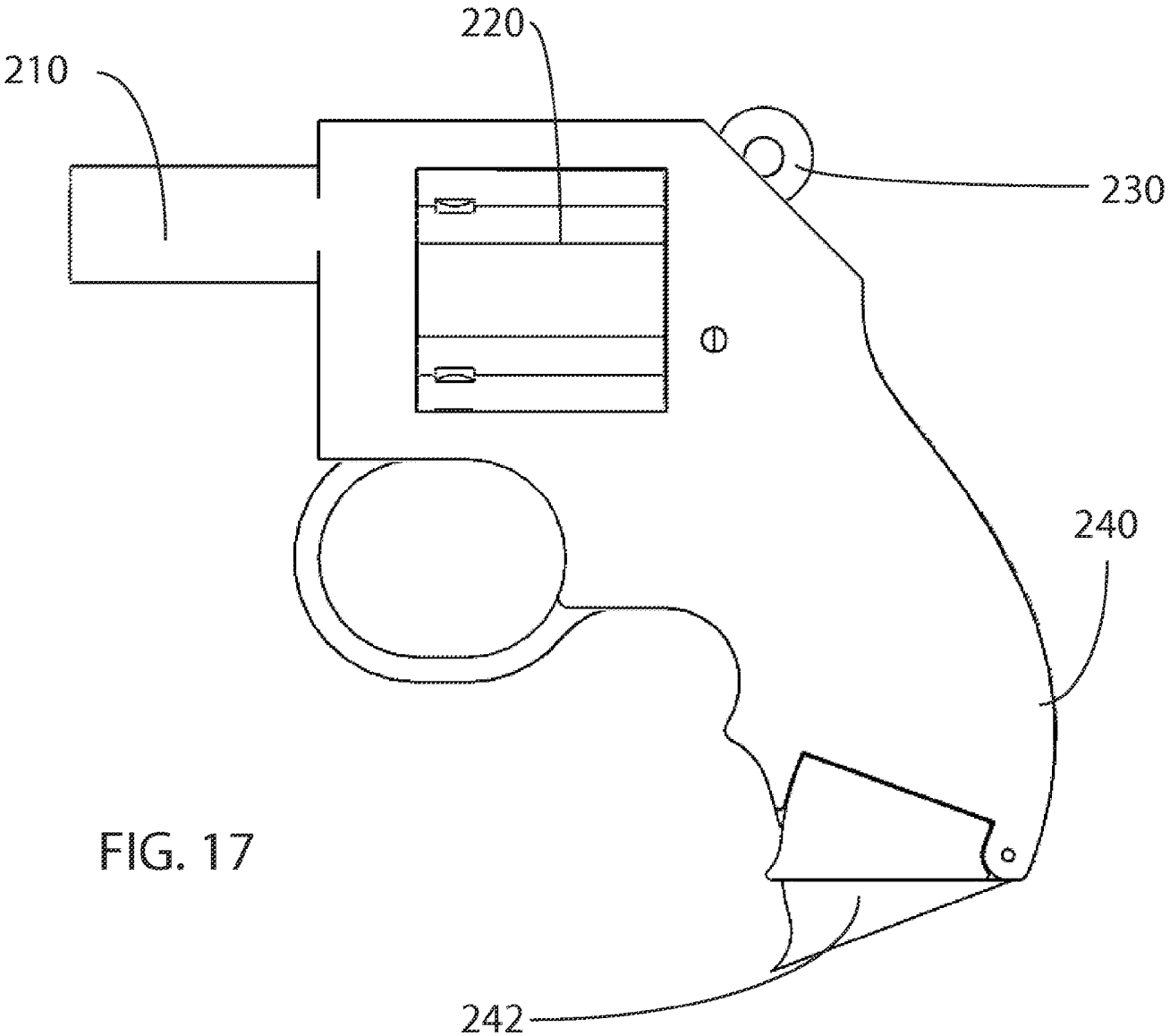
FIG. 17 is a sectional view of the revolver of FIG. 15, with a deployed grip extension tang.
Figure 18:
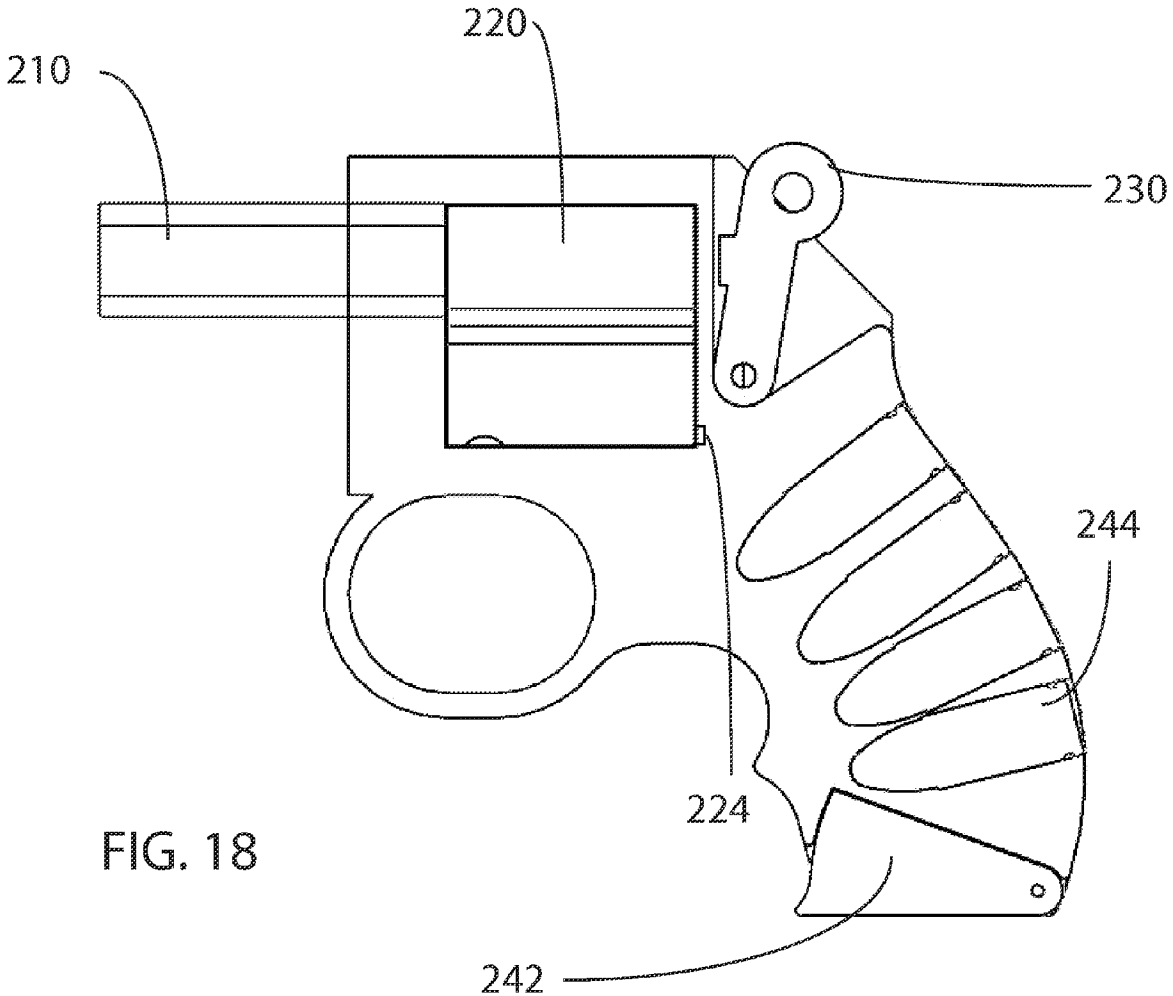
FIG. 18 is a sectional view of the revolver of FIG. 15, with cartridge storage built into the grip.

Numerous alternate embodiments may be utilized. Another revolver 200 is shown in FIGS. 15-18, where a specialized grip is used to provide a still smaller stowed profile. A grip extension tang 242 is provided in the bottom of grip 240 that may be deployed into an extended position and thus provide a larger gripping surface (FIG. 17). The tang 242 may be spring-loaded and actuated by use of a pressure plate or may be actuated by the cocking of the hammer or may be keyed to removal from a holster or any other means known in the art or later discovered. The tang 242 may also not be spring-loaded and may pivot or slide into position due to direct pressure on some part of the grip. The grip may also be specialized to contain spare ammunition 244 (FIG. 18). As other embodiments are possible, it should be noted that the revolver in FIGS. 15-18 utilizes an alternate hammer 230, rather than a full hammer and trigger assembly, thus keeping the design simple and effective. Other embodiments include the use of strikers, including bolt-action style strikers (which for purposes of this Application and interpretation of the claims shall all be considered "hammers"). Like other features of the revolver, the location and structure of the cylinder stop 124 may be varied. As can be seen in FIG. 18, an alternate cylinder stop 224 is located on a rear surface of the alternate cylinder 220 and protrudes axially therefrom, rather than the radial extension of the first disclosed embodiment. The location of the cylinder stop 124, 224 may be anywhere on the cylinder (front, back, or side wall) or frame so long as it does not impede rotation of the cylinder until it is necessary to prevent over rotation.

Figure 19:
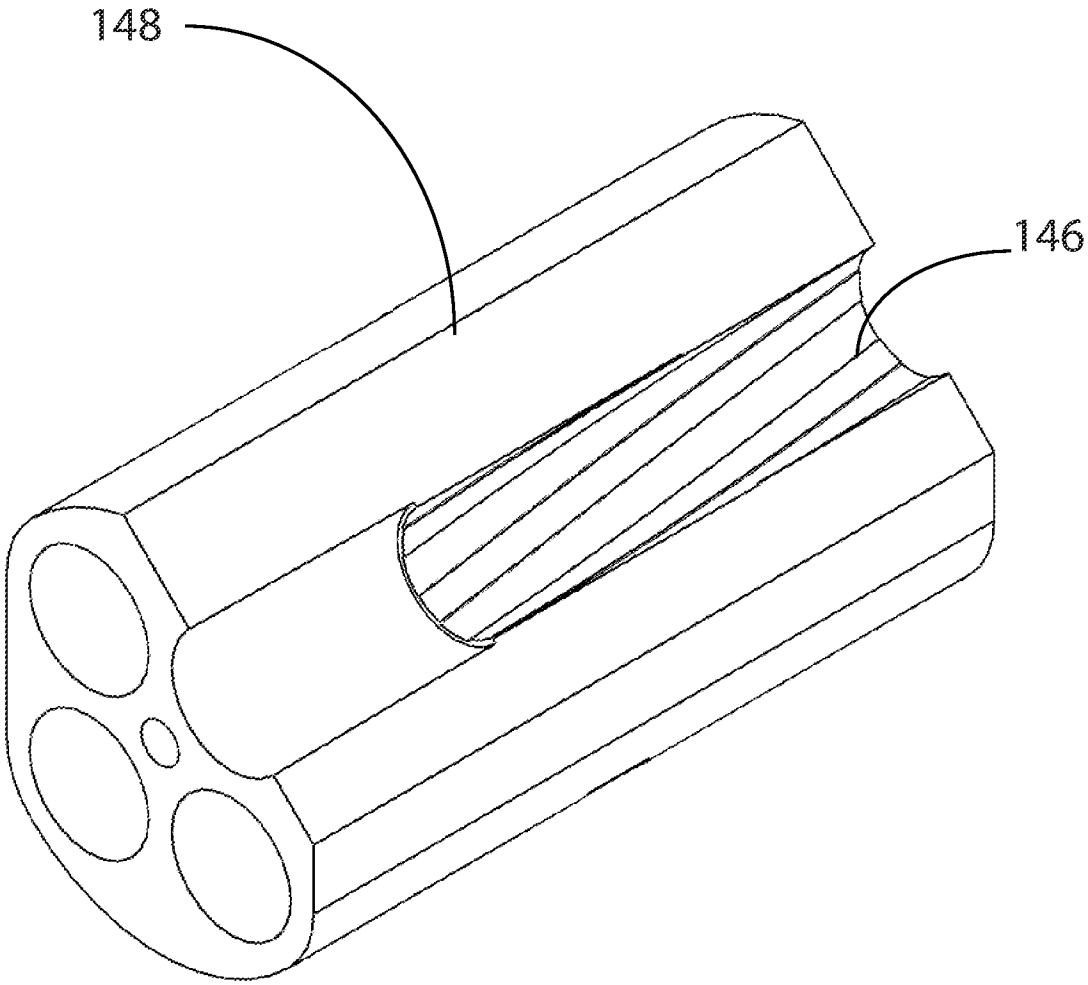
FIG. 19 is a partial sectional view of an alternate cylinder design.
Figure 20:
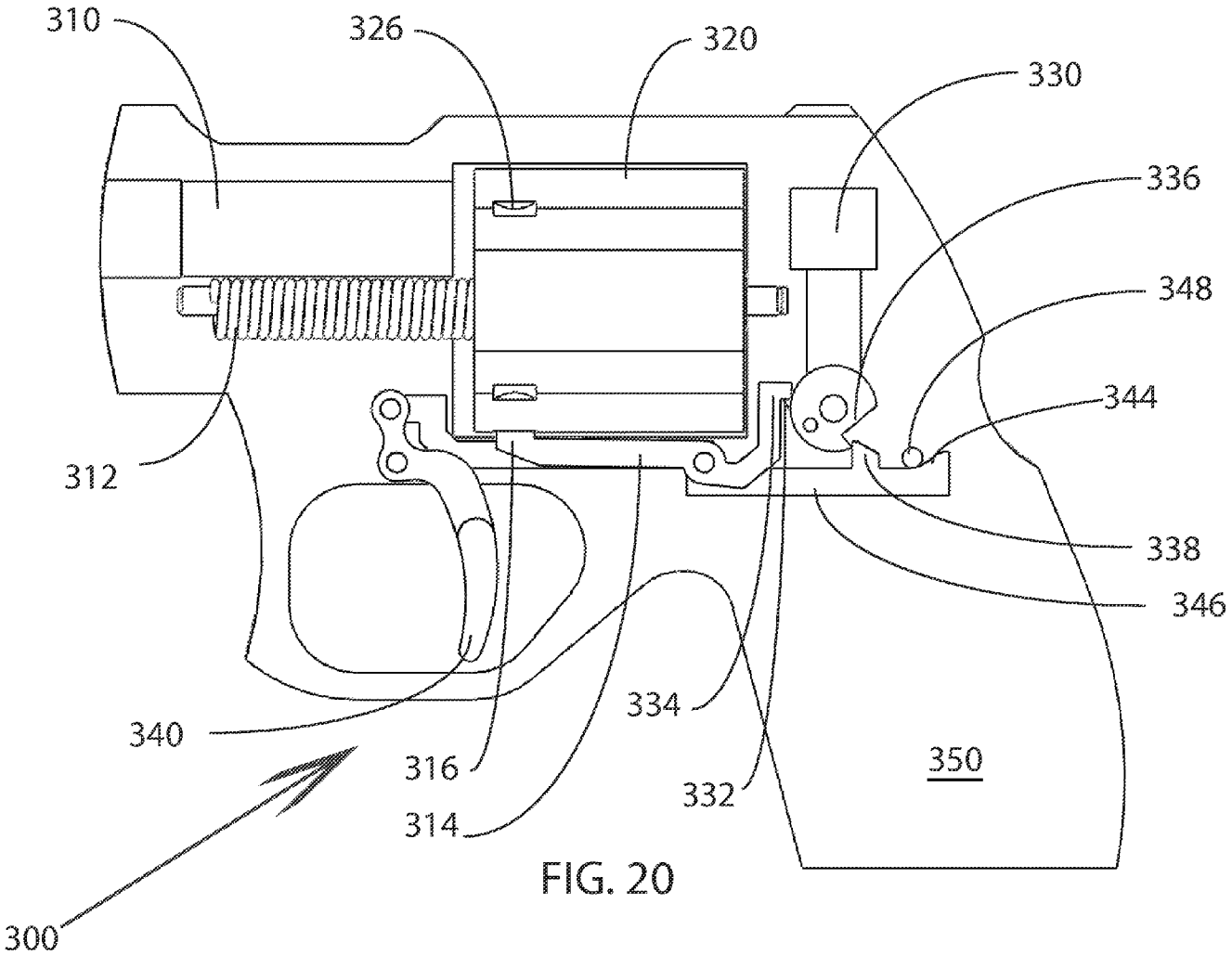
FIG. 20 is a sectional view of double action revolver in accordance with the present invention in a stowed orientation.

Another alternate embodiment provides rifling grooves 146 in the chambers (FIG. 19). This design facilitates a familiar multi-barrel, or "pepperbox," configuration of the invention. Each chamber may then originate an individual barrel.

A double action embodiment 300 is shown in FIGS. 20-23. This embodiment utilizes similar elements as the single action embodiment shown in FIG. 1, a barrel 310, cylinder 320, hammer 330, trigger 340 and grip 350 all mounted upon a frame or receiver. Like in the single action embodiment, the cylinder 320 is powered by a torsion-type cylinder spring 312 mounted beneath the barrel 310. A pivoting locking bar 314 maintains the cylinder 320 against the spring pressure. The forward end of the locking bar 314 is a locking bar key 316 designed to interface with specifically positioned lock grooves 326, 328 on a forward end of the cylinder 320. The end of the locking bar opposite the key features a locking bar plate 334 which interfaces with a pawl 332 mounted upon the hammer 330.

Figure 21:
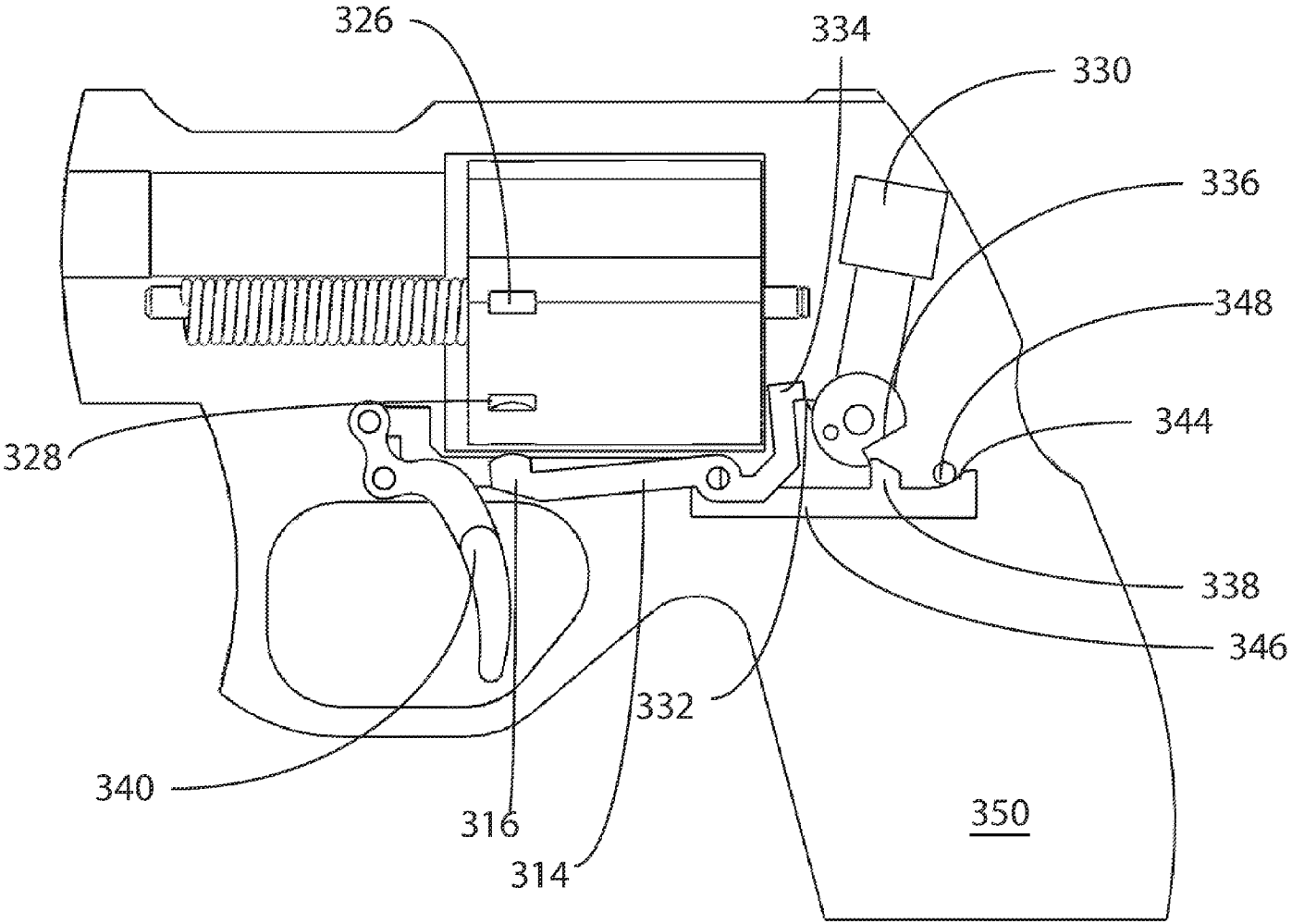
FIG. 21 is a sectional view of the revolver of FIG. 20, in the process of cocking.
Figure 22:
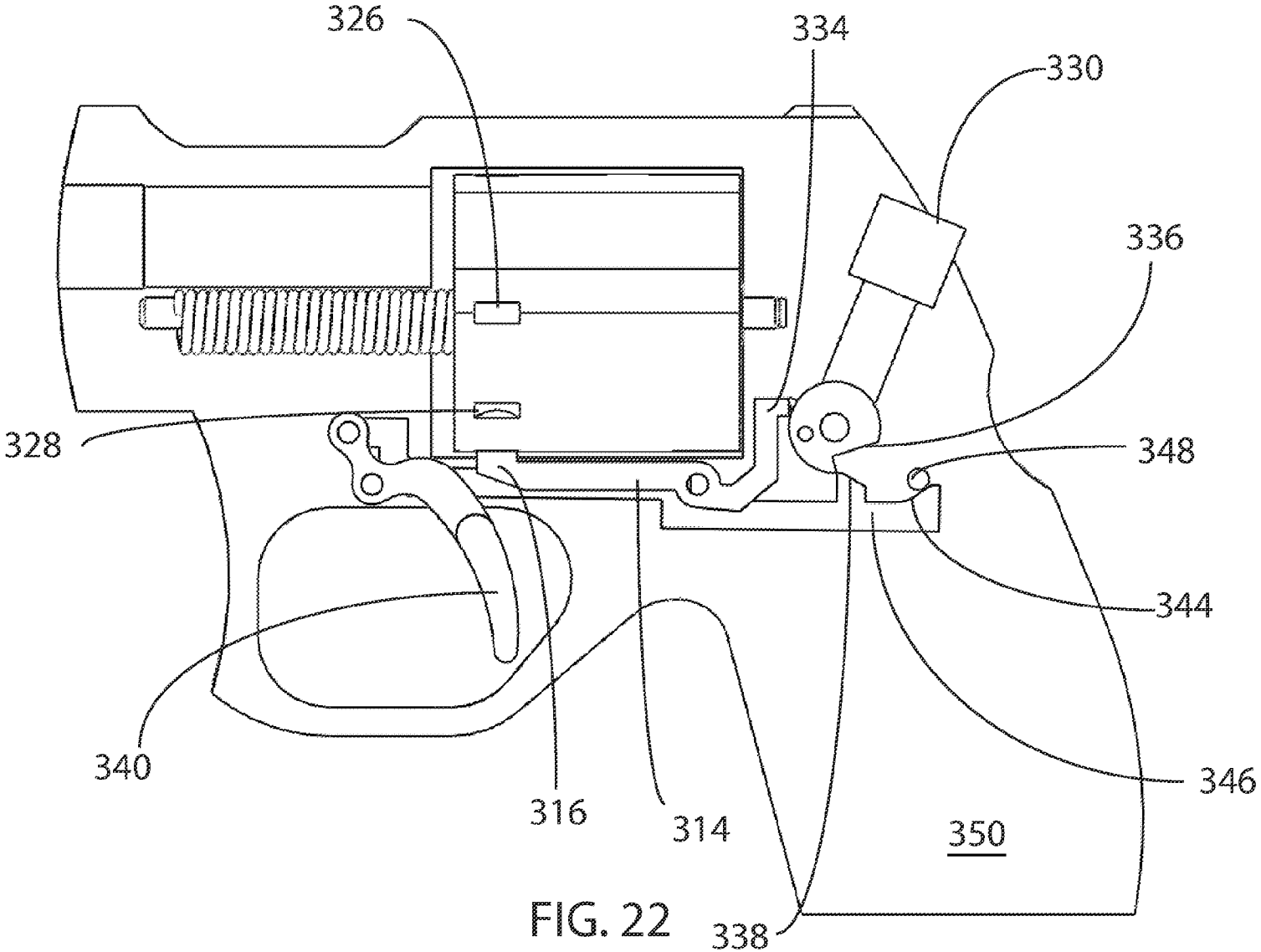
FIG. 22 is a sectional view of the revolver of FIG. 20, fully cocked.
Figure 23:
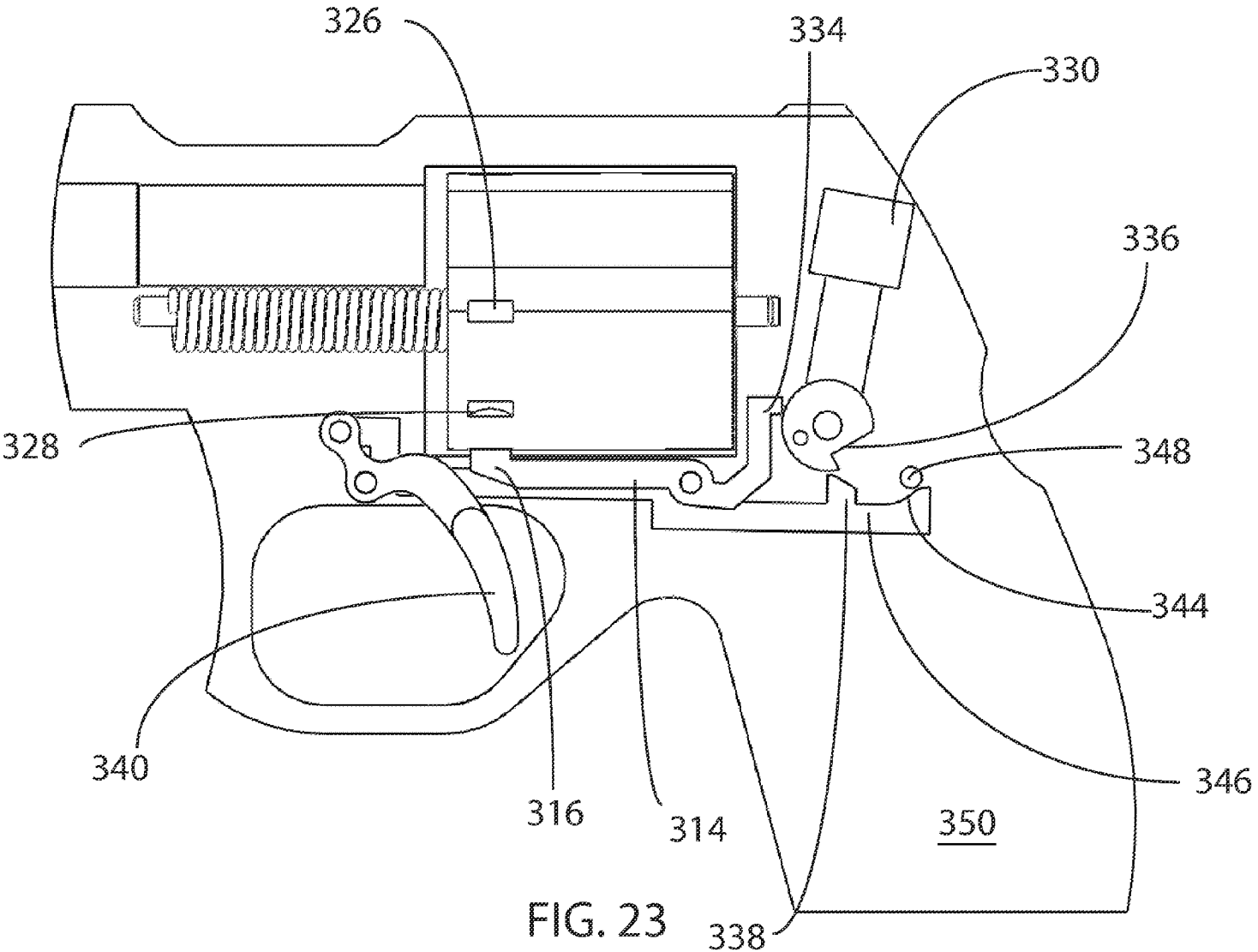
FIG. 23 is a sectional view of the revolver of FIG. 20, firing.

Pulling the trigger 340 pulls forward on drawbar 346, which is then biased downward by interaction of the guide pin 348 and end ramp 344. Sear-spur 338 is a part of the drawbar 346 and pulls on hammer detent groove 336, cocking the hammer 330 (FIG. 21). This action, in turn, drives the hammer pawl 332 against the locking bar plate 334, pushing it upwards. The mechanics then follow a similar pattern as described in the single action revolver, except that the downward pressure of the drawbar end ramp 334 and guide pin 348 move the sear-spur 338 out of connection with hammer detent groove 336, releasing the hammer 330 (FIGS. 22-23).

In practice, the most efficient method of reloading the revolver is a simple single action reload-style, which is to say open a reloading gate and release the cylinder 120 so that it may be rotated to facilitate reloading. Another method would be to utilize a frame with a breaktop feature so that the ammunition chambers are accessible for reloading. This structure tends to be simple to operate and utilizes few parts. The pivot for the breaktop may be located either above or below the cylinder and it may also be a horizontal, vertical or torsional pivot. Other structures, such as a swing out cylinder or a removable cylinder, are also possible. It should also be noted that while the two embodiments of the revolver are described as single action and double action, it may also utilize more advanced loading and advancing operational structures, such as being gas, recoil or blowback operated. No preferred ammunition style is described as any ammunition type with an internal firing primer may be used. Various grip styles may also be utilized for individual preference Although the present invention has been described with reference to preferred embodiments, numerous modifications and variations can be made and still the result will come within the scope of the invention. No limitation with respect to the specific embodiments disclosed herein is intended or should be inferred.

What is claimed is:

1. A revolver comprising:

a barrel, having a bore;

an non-radially symmetric ammunition cylinder proximate the barrel and powered by a torsion spring residing outside the cylinder and underneath the barrel, the cylinder further comprising:

a plurality of ammunition chambers; and a plurality of lock grooves located on an exterior surface of the cylinder, at least one of said lock grooves being a safety lock groove;

a pivotable locking bar, one end of said locking bar being a locking bar key; and a hammer;

wherein, when in a stowed configuration, the cylinder is situated in a manner that no chamber is centered over the bore of the barrel and the hammer and the locking bar key resides within the safety lock groove and, upon actuation of the hammer, the locking bar pivots to remove the locking bar key from the safety lock groove, freeing the cylinder to rotate, powered by the torsion spring, such that a first chamber is centered over the bore of the barrel and the hammer and the locking bar key resides in the next consecutive lock groove.

2. The revolver of claim 1, the cylinder having at least two opposing flat sides, said opposing flat sides being outwardly presented when the revolver is in a stowed configuration.

3. The revolver of claim 1, the cylinder further comprising a cylinder stop projecting from the exterior surface of the cylinder.

4. The revolver of claim 1, the locking bar further comprising a chamfer that is positioned into a path of rotation of the cylinder when the locking bar is pivoted such that the chamfer will block one corner of the cylinder, positioning it in a manner to facilitate the locking bar key to interface with one of the lock grooves.

5. The revolver of claim 1, the ammunition chambers further comprising internal rifling grooves.

6. The revolver of claim 1, further comprising a plurality of barrels, matching in number the plurality of ammunition chambers.

7. The revolver of claim 6, the torsion spring residing in a non-concentric relationship with an axis defined by the cylinder.

8. The revolver of claim 1, the revolver being a single action revolver.

9. The revolver of claim 8, further comprising:

a trigger;

a sear-spur fashioned on a trigger;

a hammer detent groove fashioned in the hammer; and a hammer pawl;

wherein the sear-spur engages the hammer detent groove after the hammer is cocked, and the cocking of the hammer moves the hammer in a manner that the hammer pawl interacts with the lock bar and allows the cylinder to advance to a next chamber.

10. The revolver of claim 8, the pawl being pivotable in relation to the hammer.

11. The revolver of claim 1, the revolver being a double action revolver.

12. The revolver of claim 11 further comprising:

a. a trigger;

b. a drawbar operatively connected to the trigger;

c. a sear-spur fashioned on the drawbar;

d. a hammer detent groove fashioned in the hammer e. a hammer pawl;

wherein the sear-spur interacts with the hammer detent groove while the trigger is being pulled, thus moving the hammer in a manner that the hammer pawl interacts with the cylinder locking bar and advances the cylinder to a next successive chamber.

13. The revolver of claim 12, further comprising a ramp, fashioned on an end of the drawbar opposite the trigger and a guide pin, positioned proximate the ramp such that when the trigger is pulled, the ramp will interface with the guide pin and said interaction will facilitate eventual disconnection of the sear-spur from the hammer detent groove.

14. A revolver comprising:

a barrel, having a bore;

an non-radially symmetric ammunition cylinder proximate the barrel and powered by a torsion spring residing outside the cylinder, the cylinder further comprising:

a cylinder stop projecting from the exterior surface of the cylinder;

a plurality of ammunition chambers; and a plurality of lock grooves located on an exterior surface of the cylinder, at least one of said lock grooves being a safety lock groove;

a pivotable locking bar, one end of said locking bar being a locking bar key; and a hammer;

wherein, when in a stowed configuration, the cylinder is situated in a manner that no chamber is centered over the bore of the barrel and the hammer and the locking bar key resides within the safety lock groove and, upon actuation of the hammer the locking bar pivots to remove the locking bar key from the safety lock groove, freeing the cylinder to rotate, powered by the torsion spring, such that a first chamber is centered over the bore of the barrel and the hammer and the locking bar key resides in the next consecutive lock groove.

15. A double-action revolver comprising:

a barrel, having a bore;

an non-radially symmetric ammunition cylinder proximate the barrel and powered by a torsion spring residing outside the cylinder, the cylinder further comprising:

a plurality of ammunition chambers; and a plurality of lock grooves located on an exterior surface of the cylinder, at least one of said lock grooves being a safety lock groove;

a pivotable locking bar, one end of said locking bar being a locking bar key;

a hammer;

a trigger;

a drawbar operatively connected to the trigger;

a sear-spur fashioned on the drawbar;

a hammer detent groove fashioned in the hammer; and a hammer pawl;

wherein, when in a stowed configuration, the cylinder is situated in a manner that no chamber is centered over either of the bore of the barrel or the hammer and the locking bar key resides within the safety lock groove and, upon actuation of the hammer, the locking bar pivots to remove the locking bar key from the safety lock groove, freeing the cylinder to rotate, powered by the torsion spring, such that a first chamber is centered over the bore of the barrel and the hammer and the locking bar key resides in the next consecutive lock groove and the sear-spur interacts with the hammer detent groove while the trigger is being pulled, thus moving the hammer in a manner that the hammer pawl interacts with the cylinder locking bar and advances the cylinder to a next successive chamber.

16. The revolver of claim 15 further comprising a ramp, fashioned on an end of the drawbar opposite the trigger and a guide pin, positioned proximate the ramp such that when the trigger is pulled, the ramp will interface with the guide pin and said interaction will facilitate eventual disconnection of the sear-spur from the hammer detent groove.

17. A cylinder for a revolver, the cylinder comprising:

a. a central axis and at least four sides, each side forming a corner with two sides adjacent thereto;

b. at least one side being convex;

c. at least two sides, adjacent the at least one convex side, being non-convex;

d. at least four chambers, each chamber individually located proximate one of the corners;

e. at least one safety notch, located on the at least one convex side;

wherein, when the safety notch is engaged, no chamber is located in a vertical orientation with respect to the central axis.

18. The cylinder of claim 17, further comprising one additional non-convex side, opposite the at least one convex side.

19. The cylinder of claim 17, further comprising only four sides, four corners and four chambers in which to hold ammunition, said chambers being located proximate the four corners of the cylinder.

* * * * *